US008943628B2

(12) United States Patent
Kim et al.

(10) Patent No.: US 8,943,628 B2
(45) Date of Patent: Feb. 3, 2015

(54) WASHING MACHINE AND A METHOD OF CONTROLLING THE SAME

(75) Inventors: Youngjong Kim, Changwon-si (KR); Sangjun Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1099 days.

(21) Appl. No.: 12/958,023

(22) Filed: Dec. 1, 2010

(65) Prior Publication Data

US 2011/0126358 A1 Jun. 2, 2011

(30) Foreign Application Priority Data

Dec. 2, 2009 (KR) ..... 10-2009-0118522

(51) Int. Cl.
*D06F 35/00* (2006.01)
*D06F 39/08* (2006.01)

(52) U.S. Cl.
CPC ..... *D06F 35/006* (2013.01); *D06F 39/08* (2013.01)
USPC ..... 8/158

(58) Field of Classification Search
USPC ..... 8/158
See application file for complete search history.

(56) References Cited

U.S. PATENT DOCUMENTS

2001/0047670 A1* 12/2001 Whah et al. ..... 68/12.02
2001/0049947 A1* 12/2001 Whah et al. ..... 68/12.02
2001/0052249 A1* 12/2001 Whah et al. ..... 68/12.04
2008/0172804 A1* 7/2008 Vanhazebrouck et al. ..... 8/158

FOREIGN PATENT DOCUMENTS

JP 08196777 A * 8/1996 ..... D06F 33/02

* cited by examiner

*Primary Examiner* — Joseph L Perrin
(74) *Attorney, Agent, or Firm* — Birch, Stewart, Kolasch & Birch, LLP

(57) ABSTRACT

Provided are a washing machine and a method of controlling the washing machine, which can effectively wet laundry by varying a spraying pattern for spraying washing water into a washing tub considering water pressure of the washing water supplied to the washing tub even when the water pressure varies.

14 Claims, 6 Drawing Sheets

FIG. 5

| Water Level | Load[Kg] | Spray Time [Sec] |
|---|---|---|
| 1 | 0.3 - 1.3 | 80 |
| 2 | 1.6 - 2.6 | |
| 3 | 2.9 - 3.9 | 120 |
| 4 | 4.2 - 5.2 | |
| 5 | 5.5 - 6.5 | 140 |
| 6 | 6.8 - 7.8 | |
| 7 | 8.1 - 9.1 | |
| 8 | 9.4 - 10.4 | 160 |
| 9 | 10.7 - 11.7 | |
| 10 | 12 - 13 | |

WASHING MACHINE AND A METHOD OF CONTROLLING THE SAME

CROSS-REFERENCE TO RELATED APPLICATION

This application claims priority from Korean Patent Application No. 10-2009-0118522 filed on Dec. 2, 2009 in the Korean Intellectual Property Office, the disclosure of which is incorporated herein by reference in its entirety.

BACKGROUND OF THE INVENTION

1. Field of the Invention

The present invention relates to a washing machine and a method of controlling the same, and more particularly, to a washing machine and a method of controlling the same, which can effectively wet the laundry by setting a spraying pattern of washing water in accordance with a water pressure at a place where the washing machine is disposed.

2. Description of the Related Art

In general, a washing machine is a machine that removes foreign substances from the laundry by treating the laundry. A process for treating the laundry by the washing machine includes a process for washing the laundry using washing water in which detergent is dissolved, a process for rinsing the laundry by supplying the washing water, which does not contain the detergent, from an outer side to a washing tub, and a process for removing the washing water out of the laundry that is washed. The process for treating the laundry may further include a process for drying the laundry and a process for discharging the laundry after ironing the laundry. However, the process for treating the laundry basically includes a detergent mixing process, a washing process, a rinsing process, and a spinning process for removing the water out of the laundry.

All of the detergent mixing process, washing process, rinsing process, and spinning process require a process for wetting the laundry by supplying the washing water into the washing tub. Generally, the washing water is supplied in a direction from a cover side toward the washing tub to wet the laundry.

However, when wetting the laundry by supplying the washing water in the direction from the cover side toward the washing tub, it is difficult to evenly wet the laundry in the washing tub. In order to overcome this limitation, a nozzle method for spraying high-pressured washing water from the cover side using a nozzle has been proposed. The nozzle method evenly wets the laundry by spraying the washing water to the laundry through a narrow water outlet. However, when spraying the washing water through the nozzle, an amount of the washing water supplied into the washing tub varies in accordance with an intensity of the pressure applied to the nozzle and thus an amount of the washing water sprayed to the laundry varies. That is, water pressure of a place where the washing machine is installed is not considered.

In addition, when the water pressure of the washing water is high, the washing water sprayed through the nozzle is not directed toward the laundry but scattered toward an inner surface of the washing tub. When the water pressure of the washing water is low, the washing water may not be properly sprayed through the nozzle.

Accordingly, a method for supplying the washing water to the washing tub considering the water pressure of the place where the washing machine is installed is required. In addition, there is a need to adjust an amount of the washing water sprayed from the nozzle along with a spraying time.

SUMMARY OF THE INVENTION

An object of the present invention is to provide a washing machine and a method of controlling the same, which can differently set a spraying pattern for spraying washing water in accordance with water pressure of a place where the washing machine is disposed.

According to an aspect of the present invention, a method of controlling a washing machine comprising a first spraying unit supplying washing water to fall into a washing tub and a second spraying unit supplying the washing water to spray over the washing tub, the method includes: determining a water pressure of the washing water supplied to the washing tub; and supplying the washing water to the washing tub by varying a spraying pattern of the first and second spraying units in accordance with the detected water pressure.

According to another aspect of the present invention, a washing machine includes: a first spraying unit for supplying washing water into a washing tub by allowing the washing water to fall into the washing tub; a second spraying unit for spraying the washing water into the washing tub; and a control unit for varying an operation and spraying time of the first and second spraying units in accordance with a water pressure of the washing water supplied to the washing tub.

According to the washing machine and the method of controlling the washing machine of the present invention, since the spraying pattern for spraying the washing water toward the laundry is set according to the water pressure of the washing water supplied to the washing machine, the washing water can be properly supplied to the laundry even when the water pressure of the washing water is high or low.

BRIEF DESCRIPTION OF THE DRAWINGS

The features and advantages of the present invention will become more apparent from reading the Detailed Description of the Invention which makes reference to the attached drawings in which:

FIG. 5 is a reference view illustrating an example of the spray-time table stored in the memory.

DETAILED DESCRIPTION OF THE INVENTION

Figure 1:
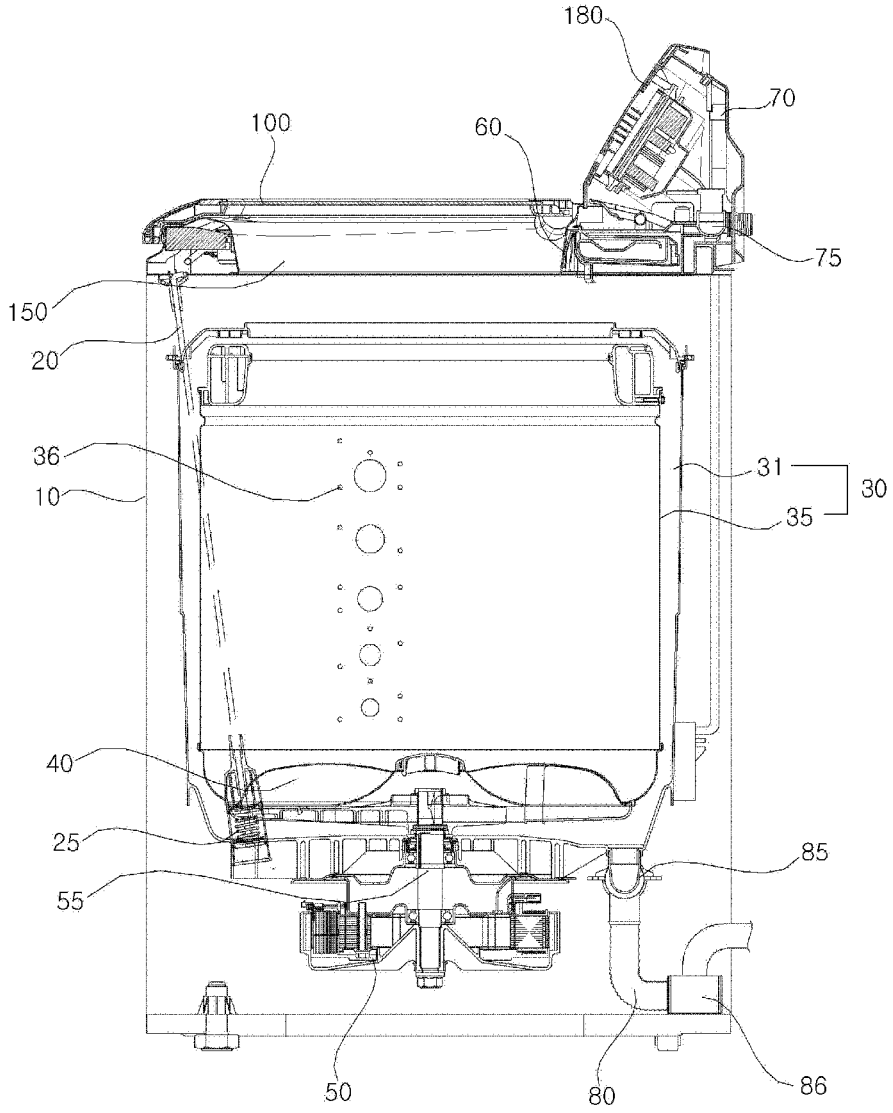
FIG. 1 is a cross-sectional view of a washing machine according to an embodiment of the present invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. Like reference numerals in the drawings denote like elements.

FIG. 1 is a cross-sectional view of a washing machine according to an embodiment of the present invention.

Referring to FIG. 1, a washing machine includes a cabinet 10, a top cover 200 that is disposed above the cabinet 10 and provided with a laundry loading/unloading opening which the laundry can be loaded and unloaded, a lid assembly 100 that is rotatably coupled to the top cover to open and close the laundry loading/unloading opening, and a control panel that provides an interface so that a user can manipulate the washing machine.

An outer tub 31 that is hung by a supporting member 20 is disposed in the cabinet 10 and an inner tub 35 is rotatably disposed in the outer tub 31.

In the present invention, when there is no need to distinguish the outer tub 31 from the inner tub 35 as different things, the inner and outer tubs 35 and 31 will be referred to as "washing tub 30" hereinafter. In the present invention, when describing a wash cycle in which a liquid detergent that is formed by mixing a detergent with washing water is sprayed, the outer and inner tubs 31 and 35 will not be described as separate things.

A damper 25 for absorbing shaking of the outer tub 31, which is caused by vibration that is generated during rotation of the inner tub 35, is disposed on a lower end of the supporting member 20. A pulsator 40 for forming a rotational water stream is disposed on a bottom of the inner 35.

In addition, a motor 50 that is a driving unit for rotating the inner tub 35 and the pulsator 40 is disposed under the outer tub 31. The motor 50 is connected to the inner tub 35 through a rotational shaft 55 to rotate the inner tub 35. A clutch (not shown) for selectively transmitting torque of the motor 50 to the inner tub 35 and the pulsator 40 may be disposed between the inner tub 35 and the pulsator 40. Accordingly, depending on the operation of the clutch, only one of the inner tube 35 and the pulsator 40 may rotate or both of the inner tube 35 and the pulsator 40 may simultaneously rotate.

Meanwhile, a detergent box 15 for storing the detergent is detachably disposed on the top cover 200. A water supply hose 70 that is connected to an outer water source to supply washing water to the detergent box 60 and a water supply valve 75 for controlling the washing water introduced through the water supply hose 70 are disposed. When the water supply valve 75 is opened and thus the washing water is supplied from the outer water source, the washing water is directed to the detergent box 60, after which the washing water is supplied to the inner tub 35.

The washing water that is supplied from the detergent box 60 to the inner tub 35 is filled in the outer tub 31 through a plurality of water holes 36 formed on the inner tub 35 and the laundry is received in the inner tub 35.

Further, a drain hose 80 for draining the washing water in the outer tub 31 to an external side and a drain adjusting valve 85 for controlling the washing water that is being drained through the drain hose 80, and a drain pump 86 are provided on a lower end of the outer tub 31.

Figure 2:
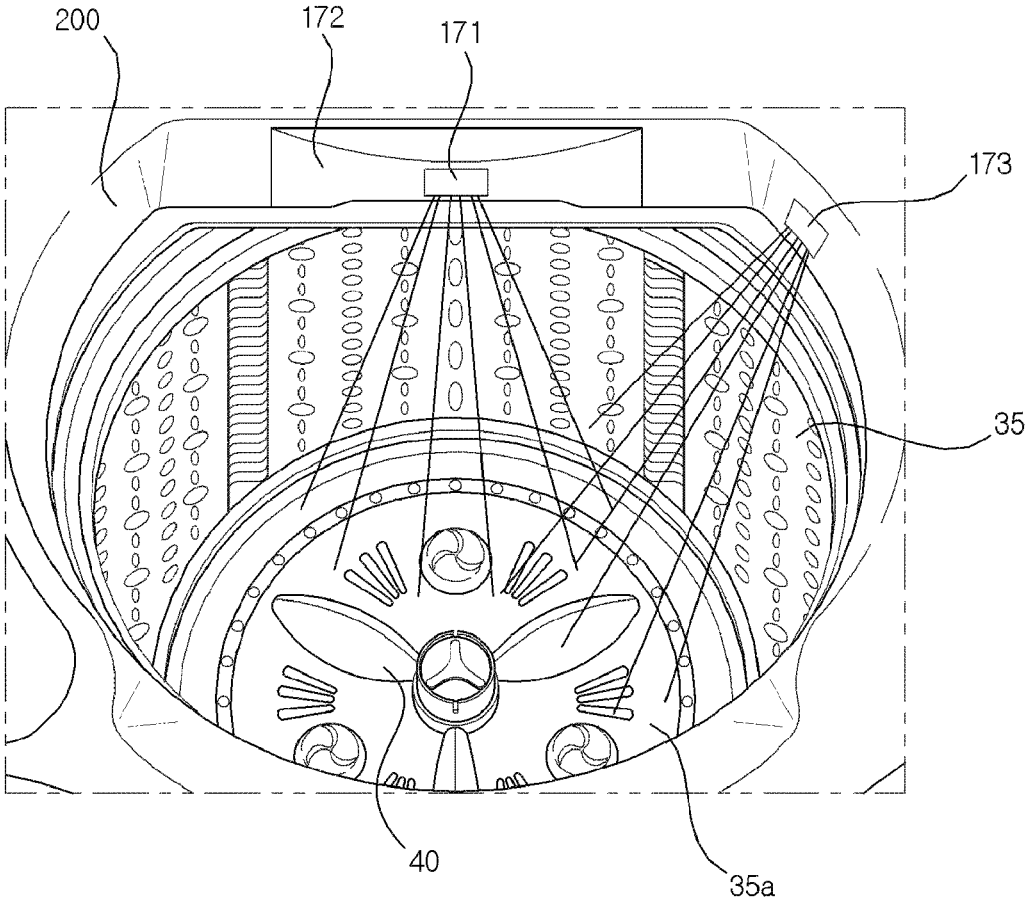
FIG. 2 is a reference view for describing washing water supply forms of first and second spraying units of a washing machine according to an embodiment of the present invention.

FIG. 2 is a reference view for describing washing water supply forms of first and second spraying units of the washing machine according to an embodiment of the present invention;

Referring to FIG. 2, the washing machine further includes first and second spraying units 171 and 173 for supplying the washing water.

The first spraying unit 171 sprays the washing water received in the detergent box 172 toward a bottom surface 35*a* of the inner tub 35 and the second spraying unit 173 sprays the washing water received in the detergent box 182 toward an inner-side surface or the bottom surface 35*a* of the inner tub 35. At this point, in order to properly set the laundry, the first and second spraying units 171 and 173 may spray the washing water toward the inner-side surface or bottom surface of the inner tub 35 in accordance with a spraying method. In addition, the spraying directions of the first and second spraying units 171 and 173 may be set such that the washing waters sprayed from the first and second spraying units 171 and 173 do not interfere with each other. Although the first and second spraying units 171 and 173 are disposed on the top cover 200, the present invention is not limited to this.

The first and second spraying units 171 and 173 are driven when the washing machine perform a water supply cycle. The water supply cycle means a cycle for supplying the washing water into the washing tub 30. In more detail, the water supply cycle includes a cycle for supplying the washing water into the washing tub 30 to wet the laundry, a cycle for supplying the washing water into the inner tub 35 to wash and rinse the laundry, and other cycles for supplying the washing water into the inner tub 35.

One or both of the first and second spraying unit 171 and 173 may be selectively driven depending on a water pressure of the washing water introduced into the washing machine.

The water pressure of the washing water introduced into the washing machine is different depending on a place where the washing machine is installed. When the water pressure of the place where the washing machine is within a low water pressure range, it is difficult for the second spraying unit 173 using a jet spray to spray the washing water and thus it is difficult to properly wet the laundry. On the other hand, the first spraying unit 171 for allowing the washing water introduced into the detergent box 172 to fall onto the bottom surface 35*a* of the washing tub can wet the laundry even in a low water pressure level.

Accordingly, when the water pressure is within the low water pressure range, only the first spraying unit 171 is driven to spray the washing water into the washing tub 30. When the water pressure is within a normal water pressure range, only the second spraying unit 173 is driven to spray the washing water into the inner tub 35.

If the water pressure of the washing water introduced into the washing machine is within a high water pressure range, both of the first and second spraying units 171 and 173 are driven together to spray the washing water into the inner tub 35.

When the water pressure of the washing water introduced into the washing machine is within the high water pressure range and only the second spraying unit 173 is driven to spray the washing water, the uniformity of the washing water sprayed from the second spraying unit 173 may be deteriorated due to the high water pressure of the washing water or the washing water may not be sprayed in a desired direction but may be scattered. Accordingly, when the water pressure of the washing water is within the high water pressure range, both of the first and second spraying units 171 and 173 are driven together to spray the washing water into the inner tub 35, thereby properly wetting the washing water.

Meanwhile, when the water pressure of the washing water introduced into the washing machine, the spraying time of the washing water sprayed from the first and second spraying units 171 and 173 into the inner tub 35 may be shortened as compared with the case where the water pressure is within the normal range. In addition, when the water pressure of the washing water introduced into the washing machine is within the low water pressure range, the spraying time of the washing water sprayed from the first and second spraying units 171 and 173 into the inner tub 35 may be prolonged as compared with the case where the water pressure is within the normal water pressure range.

That is, as the water pressure of the washing water increases, the spraying time of the washing water from the first and second spraying units 171 and 173 should be shortened. In addition, as the water pressure of the washing water decreases, the spraying time of the washing water from the first and second spraying units 171 and 173 should be prolonged. By doing this, the washing water can be properly introduced into the inner tub 35.

In this embodiment, the high water pressure range is about 7.0-10 kgf, the normal water pressure range is about 2.0-6.3 kgf, and the low water pressure range is about 1.5 kgf or less.

However, the high, normal, low water pressure ranges are only for this embodiment, they may vary in accordance with a type of the washing machine.

Figure 3:
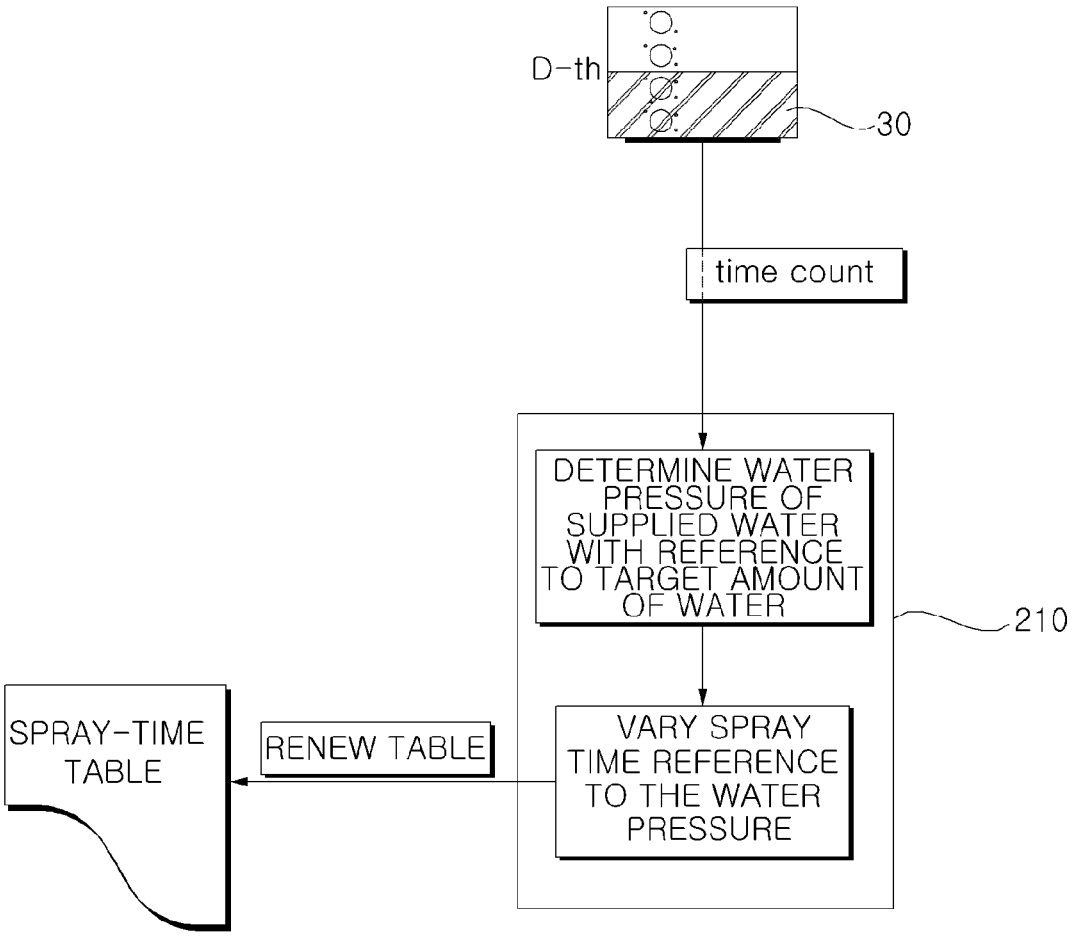
FIG. 3 is a reference view illustrating a water pressure determining method of the washing machine of FIG. 1.

FIG. 3 is a reference view illustrating a water pressure determined method of the washing machine of FIG. 1.

Referring to FIG. 3, a water pressure determined method according to an embodiment of the present invention uses a property where, as the time for introducing a reference amount D-th of the washing water into the washing tub 30 increases, the water pressure is reduced and, as the time for introducing the reference amount D-th of the washing water into the washing tub 30 is reduced, the water pressure increases.

Here, the reference amount D-th is determined depending on an amount of the laundry loaded in the washing tub. If a large amount of the laundry is loaded in the washing tub 30, the reference amount D-th of the washing water introduced into the washing tub 30 increases. On the other hand, when a small amount of the laundry is loaded in the washing tub 30, the reference amount D-th of the washing water introduced into the washing tub 30 is reduced. The reference amount D-th to the amount of the laundry is defined by a data file provided in the form of a reference table. The reference table may be recorded in a control unit 210 to be reprogrammable or may be stored in an external memory (not shown) connected to the controlled unit 210. The reference table will be described in detail later.

The control unit 210 measures time required for the amount of the washing water introduced into the washing tub 30 to reach the reference amount D-th and determines the water pressure of the washing water introduced into the washing tub 30 with reference to the measured time. The water pressure is reduced as the time required for the amount of the washing water to reach the reference amount D-th increases. In addition, the water pressure of the washing water introduced into the washing tub 30 is determined by an amount of the water supplied to the washing tub 30 per a predetermined time (e.g., 10 seconds).

When the amount of the washing water introduced into the washing tub 30 reaches the reference amount D-th, the control unit 210 calculates the water pressure of the washing water and determines the spraying time for spraying the washing water toward the laundry loaded in the washing tube 30 in accordance with the calculated water pressure.

The memory (not shown) further includes a spray-time table defining the spraying time of the washing water into the washing tub 30 in accordance with the amount of the laundry.

The control unit 210 renews the time information recorded in the spray-time table with reference to the water pressure that is calculated based on the time required for the amount of the washing water to reach the reference amount D-th. For example, when it is assumed that the spraying time for spraying the washing water for 1 Kg laundry is about 80 sec, the substantial spraying time may be 90 sec when the water pressure is low and the spraying time recorded in the spray-time table is renewed from 80 sec to 90 sec to adjust the spraying time of the washing water toward the laundry in response to the water pressure of the place where the washing machine is installed.

Figure 4:
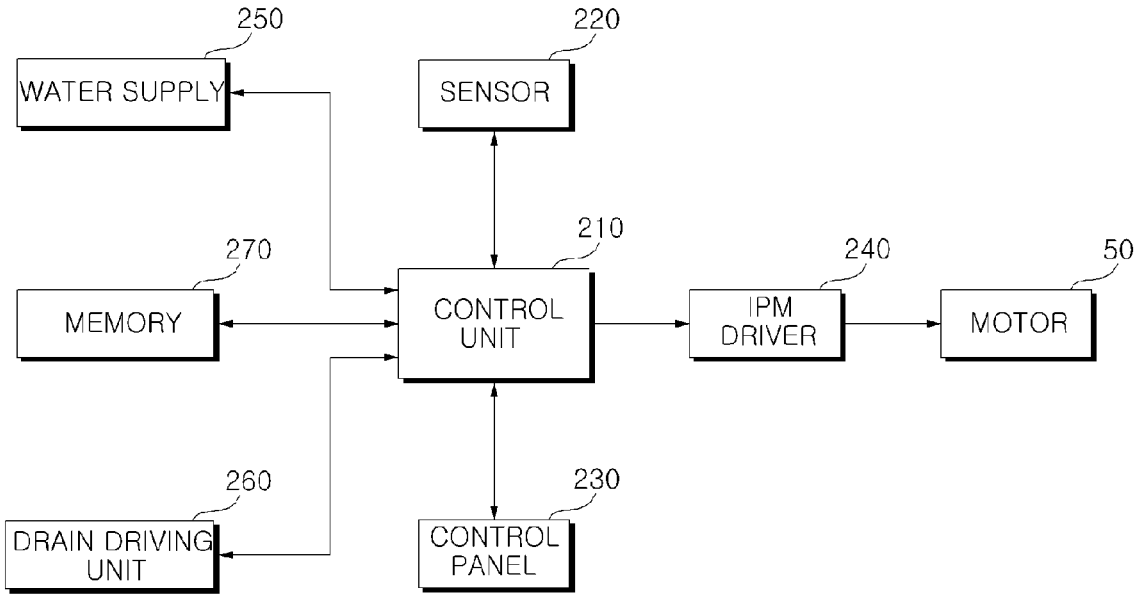
FIG. 4 is a reference view illustrating a control flow of the washing machine according to an embodiment of the present invention.

FIG. 4 is a block diagram illustrating a control flow of the washing machine according to an embodiment of the present invention.

Referring to FIG. 4, when a user set a washing course and a washing time by manipulating the control panel 230 after loading the laundry in the washing tub 30, the control unit 210 determines, in accordance with the washing course, an amount of the washing water, an amount of the detergent, a time for rotating the washing tub 30, and a rotational pattern. According to the determined conditions, the control unit 210 supplies the detergent into the washing tub 30, after which the control unit 210 controls a water supply driving unit 250 to primarily supply the washing water into the washing tub 30. At this point, the amount of the washing water supplied to the washing tub 30 is controlled with reference to an amount detected by a sensor 220.

The memory 270 has the spray-time table that defines the time for spraying the washing water into the washing tub 30 according to the amount of the washing water and the amount of the laundry and the reference table for calculating the water pressure of the washing water supplied through the water supply driving unit 250.

The spray-time table defines, in accordance with the amount of the laundry loaded in the washing tub 30, an amount of the water that will be supplied to the washing tub 30 and the time for spraying the washing water to the washing tub 30.

The reference table has the time required for filling the washing tub with the washing water to the reference amount according to the amount of the laundry and data of the water pressure of the washing water or an equation for calculating the water pressure.

The control unit 210 sets a spraying pattern for selectively driving one of the first and second spraying units 171 and 173 or driving both of the first and second spraying units 171 and 173 with reference to the water pressure of the washing water.

The spraying pattern includes a first spraying pattern applied when the water pressure is greater than a reference water pressure, a second spraying patter applied when the water pressure is less than the reference water pressure, and a third spraying pattern applied when the water pressure is a normal water pressure.

The first spraying pattern corresponds to a pattern for simultaneously driving both of the first and second spraying units 171 and 173. The first spraying pattern is set by the control unit 210 when the water pressure is about 7.0 kgf or more that is greater than the reference water pressure (2.0-6.5 kgf). The first spraying pattern drives both of the first and second spraying units 171 and 173 together. When the water pressure is greater than the reference pressure and only the second spraying unit 173 performing the jet spray is driven, the washing water from the nozzle of the second injection unit 173 is scattered by the high pressure and this it is difficult to properly wet the laundry.

Accordingly, by allowing both of the first and second spraying units 171 and 173 to sprays together the high-pressured washing water into the washing tub 30, the limitation in that the washing water is not directed toward the laundry but scattered can be solved.

The second spraying pattern corresponds to a pattern for driving when the water pressure is about 1.5 kgf or less that is less than the reference pressure. The second spraying pattern is set by the control unit 210 when it is difficult to drive the nozzle of the second spraying unit 173 using the washing water that is in a low pressure state. The second spraying pattern allows the washing water to fall into the washing tub 30 through the first spraying unit 171 connected to the detergent box 172. When the water pressure of the washing water is low, it is not appropriate to use the second spraying unit 173 performing the jet spray through the nozzle. At this point, like the typical washing machine, the control unit 210 allows the washing water introduced into the detergent box to fall into the washing tub 30, thereby wetting the laundry.

The third spraying pattern corresponds to a pattern for driving the second spraying unit 173 when the water pressure is within the reference water pressure range (2.0-6.5 kgf). When the water pressure is within the reference water pressure range, it is possible to perform the jet spray using the second spraying unit 173. When the third spraying pattern is applied, it is possible to wet the laundry using the washing water sprayed through the second spraying unit 173.

Meanwhile, in order to use the above-described spraying patterns, the control unit 210 needs to accurately determine the water pressure of the washing water. The control unit 210 determines the amount of the washing water introduced into the washing tub 30 depending on the amount of the laundry. Hereinafter, the amount of the washing water, which is determined depending on the amount of the laundry, will be referred to as "reference amount." The reference amount is determined when the laundry is loaded in the washing tub 30.

The control unit 210 measures time required for the amount of the washing water introduced into the washing tub 30 to reach the reference amount and calculates the water pressure based on the measured time. When the time required for the washing water to reach the reference amount is short, the water pressure is high. On the other hand, when the time required for the washing water to reach the reference amount is long, the water pressure is low. The reference amount and the water pressure data in accordance with the time required for the water amount to reach the reference amount are recorded on the reference table stored in the memory 270. The control unit determines the water pressure of the washing water introduced through the water supply driving unit 250 with reference to the time and water pressure data that are recorded on the reference table. At this point, the control unit 210 identifies a time point at which the amount of the washing water reaches the reference amount through the sensor 220 and applies the identified time point to the water pressure calculation. Here, the reference table is recorded on the memory 270 when a manufacturer designs and manufactures the washing machine.

The control unit 210 determines the spraying time of the washing water sprayed into the washing tub 30 with reference to the water pressure of the washing water introduced into the washing tub 30 through the water supply driving unit 250. The spraying time of the washing water is determined by varying the time written on the spray-time table recorded on the memory 270.

For example, when the water pressure of the washing water introduced into the washing tub 30 is reduced by 10% and thus the time for introducing the washing water into the washing tub 30 is retarded by 10%, the control unit 210 may increase the time for spraying the washing water into the washing tub 30 by 10% in inverse proportion to the reduction of the water pressure by 10%. At this point, the control unit 210 may renew the spraying time written on the spray-time table by increasing the spraying time by 10%.

In general, when it is consumed that the water pressure of the washing water introduced into the washing machine is constant, the control unit 210 may spray the washing water into the washing tub 30 and performs the wash cycle using the renewed spray-time table.

When the washing machine is installed at a place where the water pressure frequently varies, the control unit 210 determined the water pressure of the washing water and renews the spray-time table whenever a laundry treating cycle is performed.

Next, the control unit 210 rotates the washing tub 30 or the pulsator 40 by driving the IPM driver in accordance with the washing course and washes the laundry using frictional force generated by the washing tub 30 or the pulsator 40. The IPM driver is a driver for driving the motor 50. The IPM driver 240 rotates the motor 50 clockwise or counterclockwise by controlling a voltage and current applied to the motor 50.

When the control unit 210 drives the motor 50 by controlling the IPM driver 240, the control unit 210 drives the motor 50 such that the motor alternately repeats the clockwise rotation and the counterclockwise rotation, whereby the washing tub 30 or the pulsator 40 can alternately repeat the clockwise rotation and the counterclockwise rotation. As a result, the washing efficiency can be improved.

At this point, the control unit 10 may form a rising water stream in the washing tub 30 by rotating the washing tub 30 or the pulsator 40 and allows the washing water containing the detergent to be well mixed with the laundry using the rising water stream.

Finally, after the wash cycle by the washing course set by the user is performed, the control unit 210 drains the washing water that is fully filled in the washing tub 30 by driving the drain adjusting valve 85 and the drain pump 86 through the drain driving unit 250 and supplies new washing water to the washing tub 30 through the water supply driving unit 260, after which the control unit 210 performs the spinning cycle for the laundry using the new washing water.

FIG. 5 is a reference view illustrating an example of the spray-time table stored in the memory.

Referring to FIG. 5, the spray-time table has 10 water amount sections in accordance with the amount (kg) of the laundry loaded in the washing tub 30. In each section, the amount of the laundry corresponds to the spraying time of the washing water sprayed toward the laundry.

In FIG. 5, the first water amount section is a section corresponding to the laundry of 0.3-1.3 kg. In addition, the spraying time of the washing water in the first water amount section is set to be 80 sec. If the laundry of about 1 kg is loaded in the washing tub 30, the control unit 210 sprays the washing water toward the laundry for 80 seconds.

The second water amount section corresponds to the laundry of about 1.6-2.6 kg. Like in the first water amount section, the spraying time of the washing water in the second water amount section is about 80 seconds. This is for simplify the algorithm by applying an identical spraying time for the sections (e.g., the first and second water amount sections) having similar amount of the laundry. However, different spraying times may be applied for the first and second water amount sections and the spray-time table also defines different spraying times for the respective water amount sections. In addition, although the water amount sections includes the first to tenth water amount sections in this embodiment, the present invention is not limited to this. For example, the number of the water amount sections may be increased or reduced in accordance with the maximum amount of the washing water.

As described above, the control unit 210 renews the time information recorded on the spray-time table considering the water pressure.

When the water pressure is low, a predetermined time is added to the time recorded on the spray-time table and the spray-time table is renewed with the added time.

Figure 6:
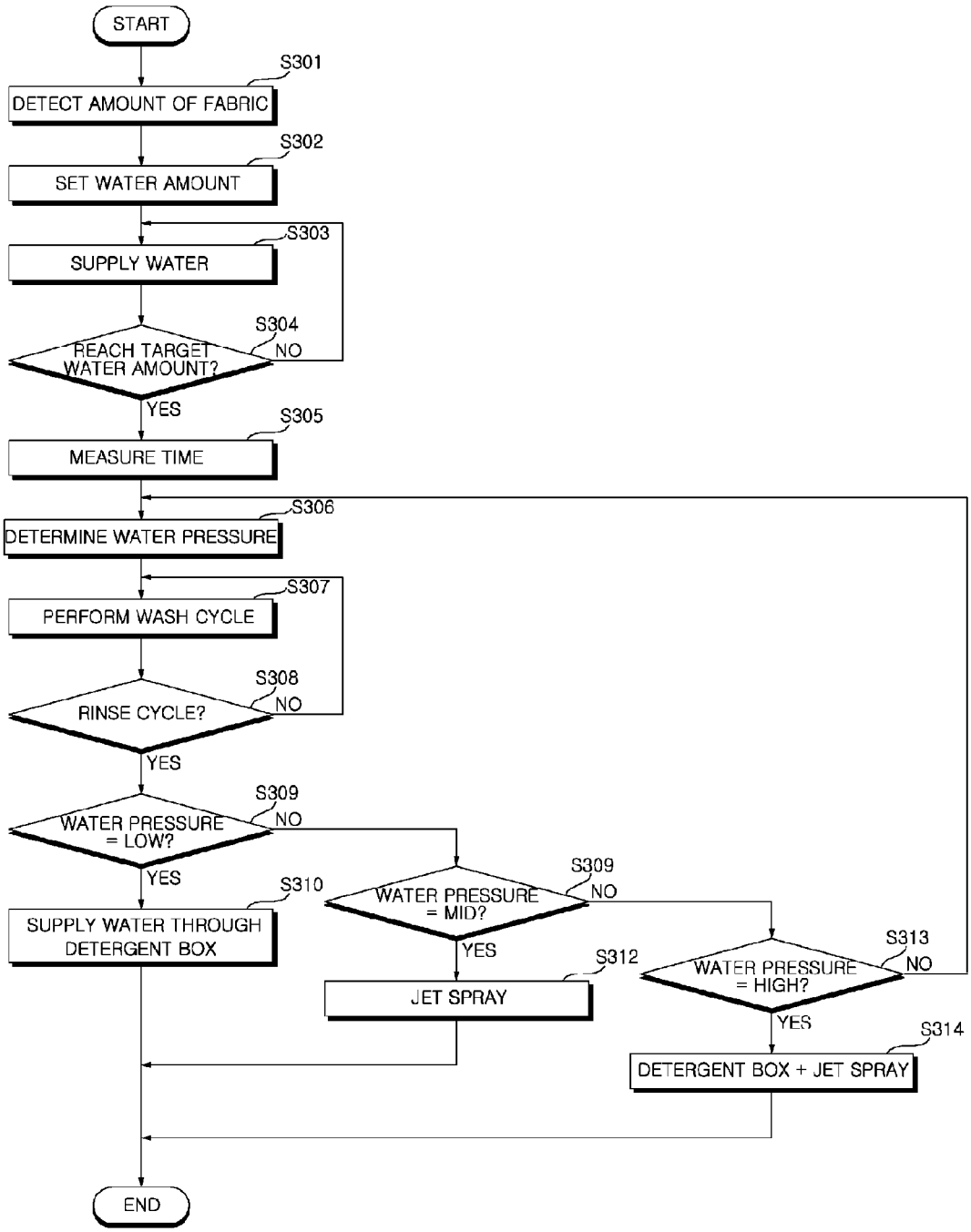
FIG. 6 is a flowchart illustrating a control method of the washing machine according to an embodiment of the present invention.

FIG. 6 is a flowchart illustrating a control method of the washing machine according to an embodiment of the present invention.

First, the control unit 210 detects the amount of the laundry loaded in the washing tub 30 using the rotation of the washing tub 30 or the pulsator 40. When the laundry is dry fabric that is relatively light, the control unit 201 accelerates the pulsator 40 in a direction at about 200 RPM, after which the control unit 201 determines the amount of the laundry with reference to a speed reduction time of the washing tub or a speed reduction gradient. At this point, when the amount of the laundry loaded in the washing tub 30 is relatively small, the speed of the pulsator 40 is steeply reduced. On the other hand, when the amount of the laundry loaded in the washing tub 30 is relatively large, the speed of the pulsator 40 is slowly reduced.

If the laundry is wet fabric that is relatively heavy, the control unit 210 accelerates the washing tub 30 instead of the pulsator 40 at about 40-60 RPM, after which the control unit 210 determines the amount of the laundry with reference to a speed reduction gradient attained when the washing tub puts on the brakes with reserve power. (S301).

The control unit 210 may detect the amount of the laundry using the wet or dry fabric. Alternatively, the control unit 210 may detect the amount of the laundry using firstly the dry fabric and detect using secondly the wet fabric. When both of the method for detecting the amount of the laundry using the dry fabric and the method for detecting the amount of the laundry using the wet fabric are used, the control unit 210 may determines a mean value of the detected amount for the dry fabric and the detected amount for the wet fabric as the amount of the laundry. Alternatively, when the dry fabric is detected and it is determined that the amount of the laundry is light, the detected amount for the dry fabric may be determined as the amount of the laundry. Alternatively, when the detected amount for the dry fabric deviates a predetermined amount (e.g., about 6 kg), the detected amount for the wet fabric may be determined as the amount of the laundry (S302).

Next, the control unit 210 determines the water amount section and spraying time that correspond to the amount of the laundry with reference to the spray-time table stored in the memory 270. At this point, the control unit 210 determines a reference amount to be supplied to the washing tub 30. When the reference amount is determined, the control unit 210 sprays the washing water into the washing tub 30 through a spraying hole provided near the cover 150 by controlling the water supply driving unit 250 (S303).

Next, the control 210 determines if the amount of the washing water sprayed into the washing tub 30 reaches the reference amount (S304), measures the time required for the amount of the washing water reaches the reference amount (S305), and determines the water pressure of the washing water with reference to the reference table stored in the memory 270 (S306).

Next, the control unit 210 performs the wash cycle for the laundry loaded in the washing tub 30 (S307). The wash cycle removes the dirt from the laundry by rotating the washing tub 30 or the pulsator 40. When there is a need to supply the water during the wash cycle, the control unit 210 may supply the washing water by driving the first spraying unit 171 or the second spraying unit 173 with reference to the water pressure that is previously measured.

Next, the control unit 210 determines if it is time to perform the rinse cycle (S308). If it is determined that it is time to perform the rinse cycle, the control unit 210 determines if the water pressure of the washing water supplied to the washing tub is low. When the water pressure is low, the control unit 210 supplies the washing water to the washing tub 30 by driving the first spraying unit 171 connected to the detergent box 172 (S310). If the water pressure of the washing water is not low, the control unit 210 determined if the water pressure is a normal pressure (S311). When it is determined that the water pressure is the normal pressure, the control unit 210 performs the jet spray toward the inner wall or bottom surface 35*a* of the inner tub 35 by driving the second spraying unit 173 (S312). When the second spraying unit 173 sprays the washing water to the laundry in the normal water pressure range, the nozzle is not overloaded and evenly sprays the washing water to the laundry through the jet spray. If the water pressure is not within the normal range, the control unit 210 determines if the water pressure is high (S313). When it is determined that the water pressure is high, the control unit 210 supplies the washing water to the washing tub 30 by driving both of the first spraying unit 171 connected to the detergent box 172 and the second spraying unit 173 performing the nozzle spray to prevent the washing from scattering by the nozzle of the second spraying unit 173.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of controlling a washing machine comprising a first spraying unit supplying washing water to fall into a washing tub and a second spraying unit supplying the washing water to spray into the washing tub, the method comprising:

determining a water pressure of the washing water supplied to the washing machine by a control unit;

determining one of a plurality of spraying patterns by the control unit in accordance with the determined water pressure, the plurality of spraying patterns including:

a first spraying pattern that drives both of the first and second spraying units; and a second spraying pattern that drives only the first spraying unit; and supplying the washing water to the washing tub by the determined spraying pattern, wherein the washing tub includes an inner washing tub.

2. The method of claim 1, in the determining of the water pressure, a time required for an amount of the washing water supplied to the washing tub to reach a predetermined reference amount is measured and determines the water pressure according to the time.

3. The method of claim 2, wherein the predetermined reference amount, the time for reaching to the predetermined reference amount, and the water pressure in accordance with the predetermined reference amount and the time are preset in a reference table, the determining of the water pressure comprise determining a current water pressure with reference to the reference table.

4. The method of claim 1, wherein each spraying pattern of the plurality of spraying patterns comprises an operation and a spraying time of each of the first and second spraying unit.

5. The method of claim 1, wherein the first spraying pattern is determined when the water pressure is greater than a predetermined reference water pressure.

6. The method of claim 1, wherein the second spraying pattern is determined when the water pressure is less than a predetermined reference water pressure.

7. The method of claim 6, wherein the second spraying pattern drains the washing water filled in the washing tub when the washing water is sprayed into the washing tub through the second spraying unit.

8. The method of claim 1, wherein the plurality of spraying patterns further include a third spraying pattern that drives the second spraying unit when the water pressure is a predetermined reference water pressure.

9. The method of claim 1, wherein the second spraying unit jet-sprays the washing water toward at least one of an inner wall and bottom surface of the washing tub.

10. The method of claim 1, wherein the spraying pattern is applied when the washing machine performs a rinse cycle for rinsing the laundry.

11. The method of claim 1, wherein the first spraying pattern comprises a spraying time for which the washing water is supplied through the first and second spraying units.

12. The method of claim 11, wherein the spraying time is set to be in reverse proportion to the water pressure.

13. The method of claim 11, wherein the spraying time is stored in advance in a spray-time table in accordance with an amount of the laundry loaded in the washing tub.

14. The method of claim 13, wherein the spraying time stored in the spray-time table is increased or reduced in accordance with variation of the water pressure.

* * * * *